US009322255B2

(12) United States Patent
Diehl et al.

(10) Patent No.: US 9,322,255 B2
(45) Date of Patent: Apr. 26, 2016

(54) DEVICE AND METHOD FOR THE RECOVERY, IN PARTICULAR IN-SITU RECOVERY, OF A CARBONACEOUS SUBSTANCE FROM SUBTERRANEAN FORMATIONS

(75) Inventors: Dirk Diehl, Erlangen (DE); Norbert Huber, Erlangen (DE); Muris Torlak, Sarajevo (BA); Bernd Wacker, Herzogenaurach (DE)

(73) Assignee: SIEMENS AKTIENGESELLSCHAFT, München (DE)

( * ) Notice: Subject to any disclaimer, the term of this patent is extended or adjusted under 35 U.S.C. 154(b) by 451 days.

(21) Appl. No.: 13/579,400

(22) PCT Filed: Dec. 2, 2010

(86) PCT No.: PCT/EP2010/006871

§ 371 (c)(1),
(2), (4) Date: Oct. 22, 2012

(87) PCT Pub. No.: WO2011/101055

PCT Pub. Date: Aug. 25, 2011

(65) Prior Publication Data

US 2013/0192831 A1 Aug. 1, 2013

(30) Foreign Application Priority Data

Feb. 22, 2010 (DE) ..... 10 2010 008 779

(51) Int. Cl.

| | |
|---|---|
| ***E21B 43/24*** | (2006.01) |
| ***E21B 43/30*** | (2006.01) |
| ***E21B 17/18*** | (2006.01) |
| ***E21B 34/06*** | (2006.01) |

(52) U.S. Cl.

CPC ..... *E21B 43/2401* (2013.01); *E21B 17/18* (2013.01); *E21B 34/06* (2013.01); *E21B 43/305* (2013.01)

(58) Field of Classification Search

USPC ..... 166/302, 60, 268, 248, 305.1, 227
See application file for complete search history.

(56) References Cited

U.S. PATENT DOCUMENTS

| | | | | |
|---|---|---|---|---|
| 4,037,655 | A | 7/1977 | Carpenter | |
| 4,084,637 | A | 4/1978 | Todd | |
| 4,362,610 | A | 12/1982 | Carpenter | |
| 4,612,989 | A * | 9/1986 | Rakach et al. | 166/263 |
| 8,091,632 | B2 | 1/2012 | Diehl et al. | |
| 2002/0011428 | A1 * | 1/2002 | Scheuerman | 208/89 |
| 2003/0102304 | A1 * | 6/2003 | Boyers | 219/628 |
| 2003/0141053 | A1 | 7/2003 | Yuan et al. | |
| 2006/0151166 | A1 | 7/2006 | Montgomery et al. | |
| 2007/0108068 | A1 * | 5/2007 | Suh et al. | 205/766 |

(Continued)

FOREIGN PATENT DOCUMENTS

| | | | |
|---|---|---|---|
| CA | 2304938 | A1 | 2/2001 |
| DE | 102007008292 | A1 | 8/2008 |
| DE | 102007040605 | B3 | 10/2008 |
| DE | 102007036832 | A1 | 2/2009 |

(Continued)

*Primary Examiner* — Taras P Bemko

(57) ABSTRACT

A device is provided for extracting a hydrocarbon-containing substance from a reservoir. Thermal energy can be applied to the reservoir in order to reduce the viscosity of the substance. The device includes at least one conductor loop for inductively supplying electric current, to provide electric and/or electromagnetic heating, and a fluid conducting device for transporting and introducing a solvent fluid into the reservoir, to further reduce the viscosity of the substance.

12 Claims, 5 Drawing Sheets

(56) References Cited

U.S. PATENT DOCUMENTS

| | | | | |
|---|---|---|---|---|
| 2009/0009547 | A1 | 1/2009 | Udagawa | |
| 2009/0095476 | A1 * | 4/2009 | Nguyen et al. | 166/302 |
| 2010/0252249 | A1 | 10/2010 | Diehl et al. | |
| 2011/0042085 | A1 | 2/2011 | Diehl et al. | |

FOREIGN PATENT DOCUMENTS

| | | | |
|---|---|---|---|
| DE | 102007040606 | B3 | 2/2009 |
| RU | 2139416 | C1 | 10/1999 |
| RU | 2231631 | C1 | 6/2004 |

* cited by examiner

DEVICE AND METHOD FOR THE RECOVERY, IN PARTICULAR IN-SITU RECOVERY, OF A CARBONACEOUS SUBSTANCE FROM SUBTERRANEAN FORMATIONS

CROSS REFERENCE TO RELATED APPLICATIONS

This application is the US National Stage of International Application No. PCT/EP2010/068731, filed Dec. 2, 2010 and claims the benefit thereof. The International Application claims the benefits of German application No. 10 2010 008 779.3 DE filed Feb. 22, 2010. All of the applications are incorporated by reference herein in their entirety.

FIELD OF INVENTION

The invention relates to a system for in-situ recovery of a carbonaceous substance from a subterranean deposit by lowering the viscosity of said substance. Such a device serves in particular for extracting bitumen or extra-heavy oil from a reservoir below an overburden, as is the situation presented for example in the case of oil shale and/or oil sands formations in Canada.

BACKGROUND OF INVENTION

Extracting extra-heavy oils or bitumen from the known oil sands or oil shale formations requires their flowability to be increased substantially. This can be achieved by increasing the temperature of the formation (reservoir).

The most widely established and applied in-situ process for extracting bitumen or extra-heavy oil is the SAGD (Steam Assisted Gravity Drainage) method. This entails forcing water vapor under high pressure through a pipeline (well) running horizontally inside the seam. The heated, molten bitumen or extra-heavy oil separated from the sand or rock percolates down to a second pipeline or well located approximately 5 m deeper, through which the liquefied bitumen or extra-heavy oil is extracted, the spacing between injector and production pipeline or well being dependent on the reservoir geometry.

With this system, the water vapor has to fulfill a number of tasks simultaneously, namely introducing the thermal energy required to produce the liquefaction, separating out the bitumen or oil from the sand, and building up the pressure in the reservoir in order on the one hand to make the reservoir geomechanically permeable for bitumen transportation (permeability) and on the other hand to enable the bitumen to be extracted without additional pumps.

The SAGD method starts with steam being introduced through both pipelines or wells for a period of, for example, three months in order first to liquefy the bitumen in the space between the pipelines or wells as quickly as possible. Thereafter the steam is injected through the upper pipeline or well only and the extraction through the lower pipeline or well can begin.

It is already disclosed in the German patent application DE 10 2007 008 292 A1 that the SAGD method conventionally used for this purpose can be complemented with an inductive heating device. Furthermore, the German patent application DE 10 2007 036 832 A1 describes a device in which parallel running inductor or electrode arrangements are present which are connected above ground to an oscillator or inverter.

In the earlier German patent applications DE 10 2007 008 292 A1 and DE 10 2007 036 832 A1 it is therefore proposed to overlay the injection of steam with inductive heating of the deposit. In the process resistive heating between two electrodes may also take place in addition under certain conditions.

With the above-described arrangements the electrical energy must always be conducted by way of an electrical outgoing conductor and an electrical return conductor. A not inconsiderable investment in terms of effort and cost is required for this.

In the cited earlier patent applications, individual inductor pairs consisting of outgoing and return conductor or groups of inductor pairs in different geometric configurations are supplied with electric current in order to inductively heat the reservoir. In this case it is assumed that there is a constant spacing between the inductors within the reservoir, which, given a homogeneous distribution of electrical conductivity, results in a constant heating power being output along the inductors. Described therein are the outgoing and return conductors routed spatially close together in the sections in which the overburden is penetrated in order to minimize the losses there.

SUMMARY OF INVENTION

The heating power output along the inductors can be varied, as described in the earlier applications, specifically by section-by-section injection of electrolytes, thus varying the impedance. For this, corresponding electrolyte injection devices are required, the installation of which can be difficult and time-consuming or expensive.

Starting from this premise, it is the object of the invention to further optimize the above-described device for inductively heating a reservoir.

The object is achieved according to the invention by means of the features of the independent claims Advantageous developments and embodiments of the invention are disclosed in the dependent claims.

According to the invention a device and a method for extracting a hydrocarbon-containing substance, in particular bitumen or extra-heavy oil, from a reservoir are provided, wherein thermal energy can be applied to the reservoir in order to reduce the viscosity of the substance, for which purpose at least one conductor loop for inductively supplying electric current is provided as a means of electric and/or electromagnetic heating. A fluid conducting means for transporting and introducing a solvent fluid—referred to in the following also simply as "fluid" for short—into the reservoir is provided in addition for the purpose of further reducing the viscosity of the substance and/or of displacing it from the reservoir.

The invention is accordingly concerned with "in situ" extraction, which is to say the extraction of the hydrocarbon-containing substance directly from the reservoir in which said substance has accumulated, without excavating the reservoir by open-pit mining A reservoir is primarily to be understood as an oil sands deposit which is to be found underground.

According to the invention no provision is made for introducing water vapor merely in order to heat the reservoir. However, solvents are injected, in which case the solvent fluid may be embodied as a gas, as a liquid or as a multicomponent or multiphase mixture.

The conductor loop essentially takes the form of a twisted cable which typically is sheathed by a tubular sleeve. A section of the conductor loop along the extension of the cable is referred to hereinbelow as a conductor. A conductor is understood to mean in particular a serial resonant circuit, or a part thereof, which is configured in a cable-like layout with external insulation. In an advantageous embodiment of the invention this can be surrounded by a fluid conducting means as the medium by which the solvent fluid is injected into the reservoir. Alternatively the fluid conducting means for the solvent fluid can be implemented separately from the conductor loop.

The fluid conducting means is an extended hollow body—for example a pipe or tube—through which the solvent fluid is conveyed.

Providing a fluid conducting means enables the solvent fluid to be introduced into the reservoir. Depending on the embodiment of the fluid conducting means, this can yield the following advantages:

i) Reduction in the viscosity of the hydrocarbon-containing substance that is to be extracted—the bitumen or the heavy oil—in the reservoir by means of the introduction of the solvent fluid into the reservoir.

ii) Increased displacement of the hydrocarbon-containing substance, e.g. the oil, as a result of the introduction of the fluid into the reservoir.

Point i) is advantageous by reason of the fact that reducing the viscosity of the oil is a prerequisite for its economically viable extraction. The viscosity is reduced both by the inductive heating and by the introduction of the solvent.

Re point ii): A further problem with electromagnetic inductive heating is often the lack of or inadequate displacement of the oil from the deposit during the extraction, which can adversely affect the extraction rate or even bring the extraction operation to a standstill. In the SAGD method according to the prior art the oil is displaced as a result of the expansion of the water vapor chamber in the deposit. With the electromagnetic inductive heating method provided according to the invention, no provision is made for the introduction of water vapor. The introduced solvent fluid itself, however, can be used for displacing the oil.

According to the invention, suitable candidates as solvents include not only gases—for example ethane, propane, butane, $CO_2$, $SO_2$, etc.—but also fluids—e.g. polymers or water mixtures with polymers (polyacrylamides, xanthan gum)—or water mixtures with admixture of wetting agents (e.g. tensides), each of which dissolves in the bitumen of the deposit and reduce its viscosity. The solvents can furthermore be combined or mixed—propane as solvent can for example be mixed with other gases (e.g. methane)—in order to ensure the volumetric flow rate and pressure required for displacing the oil.

In a first advantageous embodiment the conductor loop—also referred to as an inductor—and fluid conducting means—hereinafter also referred to as an injector—can be embodied separately. One or more fluid conducting means terminate in the reservoir and are embodied in such a way that the solvent fluid—or simply solvent—can permeate into the reservoir. The injector can be installed such that it runs in either a vertical or a horizontal borehole. At the same time the injector can have different positions in relation to the inductor and a production well, e.g. above the inductor or between inductor and production well pairs.

Alternatively the inductor and the injector can also be coaxially combined. The inductor can be laid in a pipe conducting the solvent—the fluid conducting means—and be positioned centrally or eccentrically. Moreover, an inductor can consist of a plurality of subconductors, with the subconductors of the inductor surrounding the fluid conducting means which is used for supplying the solvent.

The fluid conducting means can advantageously be embodied as a tube and/or pipe, a section of the conductor loop—referred to hereinafter as a conductor—being arranged inside the tube or pipe, in particular such that when the solvent fluid is supplied it flows around the conductor. Accordingly, only one borehole is required for installing the inductor and the fluid conducting means.

The tube and/or pipe can be arranged in particular approximately coaxially—centered or else off-centered—with respect to the conductor. At least one bar can be provided inside the tube and/or pipe in order to fix the conductor in position inside the tube and/or pipe. Bars can be provided repeatedly along an axial direction of the tube/pipe in order to secure the conductor in position. Alternatively a bar can also have an axial extension which, in a special embodiment, even extends over the entire length of the tube/pipe.

In a further coaxial embodiment variant the fluid conducting means can be located centrally and can be surrounded by a tubular coaxial conductor. It is advantageous in this case that the fluid is conducted through the interior, which is free of electromagnetic fields, so that even an electrically conductive fluid experiences no heating due to eddy currents.

Alternatively thereto, the conductor can also be arranged so as to be freely movable inside the tube or pipe, i.e. the conductor is uncentered in the tube or pipe and fixing means are dispensed with.

In a further embodiment the fluid conducting means can be embodied as a plurality of tubes and/or pipes. Furthermore, a plurality of capillaries and/or a porous material can be provided in order to transport the fluid in the fluid conducting means. These variants are preferably arranged in such a way that the conductor is surrounded by the plurality of tubes and/or pipes and/or capillaries and/or the porous material, the plurality of tubes and/or pipes and/or capillaries and/or the porous material and the conductor preferably being arranged inside a common tubular outer sheath. These cited means for conducting the fluid are in particular all configured running parallel to one another or twisted. These embodiments can be understood in the sense that the fluid does not flow directly around the conductor, but that tubes/pipes are attached to the conductor from outside.

It should be mentioned for the sake of completeness that a reverse approach is also conceivable, whereby a conductor is composed of a plurality of subconductors and said subconductors can be arranged around the fluid conducting means.

According to the invention the fluid conducting means is perforated, such that when a fluid is supplied the fluid permeates or is introduced into the reservoir through the perforation from the fluid conducting means. By perforation is meant for example holes or slots which are contained in a fluid conducting means so that the fluid can escape from the interior of the fluid conducting means to the outside into the environment of the holes or slots. In addition to the cited holes and slots it is also possible for the fluid conducting means to consist at least in part of porous material or capillaries so that the fluid can be discharged through said means to the environment.

Preferably the perforation can be embodied in such a way and/or means can be provided so that an infiltration of solid bodies and/or sands from the reservoir is substantially prevented.

The perforation is preferably to be embodied in such a way that—apart from the supply from the surface to the target region in the reservoir—the same amount of fluid is discharged in each section over the entire length of the fluid conducting means.

In the above-described arrangements, in which the fluid conducting means is surrounded by the conductor, e.g. as a plurality of subconductors or as a coaxial pipe, the perforation should preferably be implemented as electrically insulating so as to ensure that no direct electrical connection is established between conductor and reservoir by way of the fluid.

Introducing the fluid into the reservoir can in this case reduce the viscosity in the reservoir and/or increase the pressure in the reservoir.

A pressure increasing means, in particular a pump, can also be provided for increasing the pressure of the fluid in the fluid conducting means so that a movement of the fluid in the fluid conducting means is achieved by way of the pressure increasing means and so that the fluid can be introduced into the fluid conducting means at increased pressure by way of the pressure increasing means. In particular it is aimed by means of the pump for as much pressure to be generated that a predetermined amount of fluid permeates into the reservoir by way of the perforation. By "increased pressure" is therefore meant that an ambient pressure in the reservoir is to be overcome. The hydrostatic pressure in the reservoir in the environment of the perforation should be exceeded so that the fluid can escape, which can be achieved for example with a pressure of 5000 hPa (5 bar) to 50000 hPa (50 bar).

In the case of a gaseous fluid a compressor can be used which can feed one or more injection boreholes and fluid conducting means routed therein. Increasing the pressure in the reservoir is advantageous in particular because the hydrocarbon-containing substance in the reservoir is more effectively displaced as a result and/or a negative pressure in the reservoir—due to the extraction of the substance—is avoided.

Preferably the pressure applied by way of the supply means to the fluid in the fluid conducting means is adjusted to a predetermined perforation in such a way that an escape of the fluid through the perforation is ensured over a relatively long period of application.

In order to increase the pressure in the reservoir further, a valve of a producer well for conveying away the liquefied hydrocarbon-containing substance out of the reservoir can be closed and opened again at a later time, dependent on a predetermined time interval having elapsed or on a predetermined pressure having been reached within the reservoir. The pressure can therefore be increased during the time interval because no material leaves the reservoir and in addition a fluid is introduced.

If there is a lack of displacement, or in order to improve the extraction of the hydrocarbon-containing substance from the reservoir, the additional installation of a pump in the producer well is conceivable.

Two fluid conducting means separated from each other can preferably be provided for the conductor loop, each for one half of the conductor loop, the two fluid conducting means terminating in the reservoir such that the full volume of the fluid can be introduced into the reservoir.

It has already been explained which composition the fluid that is injected into the reservoir may have. It is advantageous in particular in this case if some of the fluid is extracted at least partially or even completely from the extracted water-oil/bitumen mixture, for example a natural gas or water fractions. Toward that end the desired substance to be extracted should be separated from the extracted water-oil/bitumen mixture and the gaseous or aqueous residue treated or recycled. Said residue can subsequently be reintroduced into the reservoir (i.e. equivalent to a closed circuit).

BRIEF DESCRIPTION OF THE DRAWINGS

The present invention and its developments are explained in more detail below in the context of an exemplary embodiment and with reference to schematic drawings, in which.

DETAILED DESCRIPTION OF INVENTION

Parts corresponding to one another in the figures are in each case labeled with the same reference signs. Parts not illustrated in further detail are generally known prior art.

Figure 1:
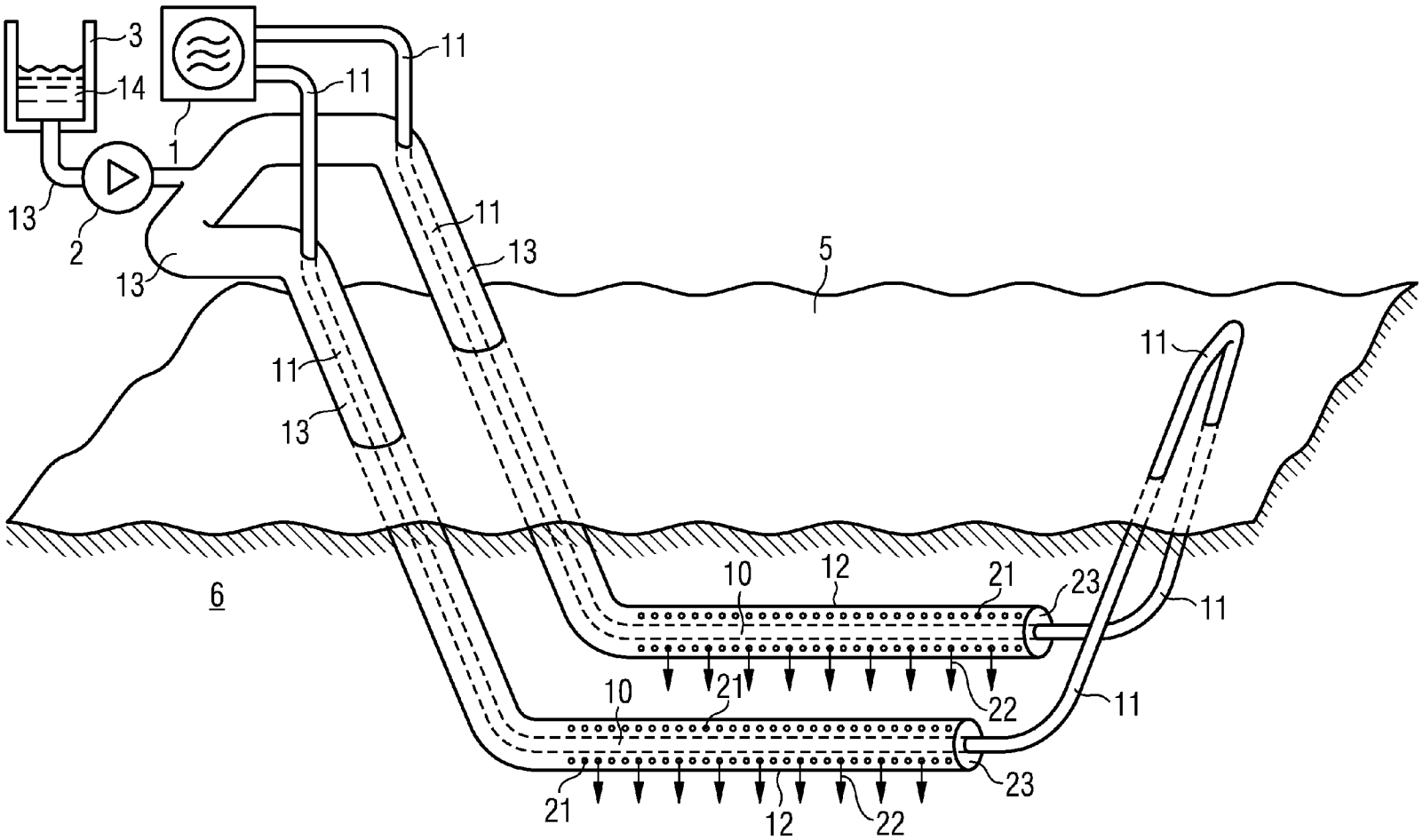
FIG. 1 shows a device for injecting a fluid into the reservoir.

FIG. 1 shows, in a schematically illustrated view, a device for in-situ recovery of a hydrocarbon-containing substance from a subterranean deposit 6 as reservoir by lowering the viscosity of said substance, wherein for that purpose provision is also made for an injection of solvents in addition to inductive heating of the reservoir by means of inductors 10. Such a device can be for example a device for recovering bitumen from an oil sands formation. The deposit 6 can be in particular an oil sands formation or an oil shale formation from which bitumen or other heavy oils can be recovered.

According to FIG. 1, a conductor loop is present which is operated by means of an electrical power supply 1. Sections of the conductor loop which act as electrodes are highlighted as inductor 10. These are the sections running horizontally and in parallel in the deposit 6.

The device for in-situ recovery of a hydrocarbon-containing substance has the cited inductor 10 which runs in boreholes inside the deposit 6. The inductor 10 or sections of the same should be regarded as a conductor and form a conductor loop. The closed conductor loop consists of the two outgoing and return conductors of the inductor 10 which run horizontally in the deposit 6, as well as of conductor pieces 11 which provide little or no heating function and run above ground or lead down from the earth's surface 5 into the deposit 6 in order to ensure the electrical power supply connection for the inductor 10. In the figure, for example, both ends of the conductor loop are arranged above ground. On the right-hand side in the figure the loop is simply closed—see conductor piece 11 in the figure. Located on the left-hand side is an electrical power supply 1, including all the requisite electrical equipment such as inverter and generator, by means of which the necessary current and the necessary voltage is applied to the conductor loop such that the inductors 10 serve as conductor for an electric/electromagnetic form of heating for generating heat in the deposit 6.

The inductors 10 are effective as a form of inductive electrical heating with respect to at least parts of the deposit 6. On account of the conductivity of at least parts of the deposit 6, the latter can be heated by means of the two sections of the inductor 10 which run largely concentrically around and as far as possible in parallel.

The inductor 10 can be composed in particular of rod-shaped metallic conductors or twisted metal cables made of an in particular highly conductive metal, which are embodied as a resonant circuit.

Not shown is a production well via which the carbonaceous substance extracted from the deposit 6 is collected and conveyed out of the deposit 6 and up to the earth's surface 5.

In order to reduce the viscosity of the substance to be extracted in the reservoir, a device is now provided by means of which a solvent fluid is introduced into the reservoir.

A storage tank 3 is present for providing a solvent fluid 14—indicated as a liquid in the diagram, though it may equally be a gas, a multicomponent gas mixture or a phase mixture—which is provided as the fluid to be injected. Said fluid 14 is introduced by means of the pump 2—or in the case of a gaseous fluid by means of a compressor—into a fluid system consisting of fluid introduction lines 13 and of a fluid conducting means 12. The fluid conducting means 12 is intended in this context to denote the sections of the fluid system running horizontally and in parallel in the deposit 6. According to the figure, the fluid introduction lines 13 are incorporated in the tube/pipe system above the earth's surface 5 and/or the connection to the horizontally running fluid conducting means 12.

In the present example, in contrast to FIG. 1, the fluid is supplied from the left on the drawing plane. In the horizontal underground section the fluid conducting means 12 has a perforation 21—or nozzles disposed in a distributed arrangement—through which the fluid 22 can escape into the reservoir (indicated by means of arrows in the figure). Furthermore, the fluid conducting means 12 terminates underground in the present example. For this purpose a termination 23 of the fluid conducting means 12 is provided, said termination likewise possibly having a perforation.

According to the figure, the conductor loop is coaxially sheathed almost completely by the fluid conducting means 12 along the length of the inductor 10, such that the inductor 10—or a jacket of the inductor 10—is surrounded by the fluid during operation. Ideally the inductor 10 is integrated into the fluid conducting means 12 and can be installed as a unit. Different embodiments of such combined conductors and fluid conducting means are explained later with reference to FIGS. 2-11.

During operation the fluid is introduced into the fluid system by means of a pump 2 or a similarly acting device. The pressure is maintained substantially unchanged as far as the perforated part of the fluid conducting means 12 because no fluid outlet is provided up to the start of the fluid conducting means 12. As the supplied fluid now reaches the section having the perforated fluid conducting means 12 according to the invention, some of the fluid is introduced into the deposit 6 via the perforation 21. A further part of the fluid flows onward along the fluid conducting means 12, some of the fluid constantly being discharged section by section by way of the perforation 21. This therefore leads to the transported fluid being diminished by the escaping fluid 22. The loss of fluid in the fluid conducting means 12 is replaced by means of the pump 2.

The resulting effect is in particular that the fluid flows into the deposit 6 in the vicinity of the inductors 10, thereby causing the viscosity in the deposit 6 to be reduced and/or the pressure in the deposit 6 to be increased. In particular a decline in pressure due to the extraction of the hydrocarbon-containing substance can be compensated for. Furthermore, depending on the composition of the fluid, the electrical conductivity in the deposit 6 can also be increased or lowered in particular in the neighborhood of the inductors 10, thus, in the event of an increase, in turn increasing the efficiency of the inductors 10. If the conductivity is lowered, the heating power density in the immediate environment of the inductor 10 can be reduced in order to lessen its thermal load.

The termination 23, the dimensions of the fluid conducting means 12, the embodiment of the perforation 21 and the pressure applied to the fluid by way of the pump 2 should preferably be aligned with respect to one another—in particular also taking into account the existing rock formations and the depth of the deposit—such that the cited effects occur substantially over the entire length of the horizontally running inductor 10 and/or such that the fluid 22 escapes uniformly into the deposit 6.

The pressure applied is dependent on the depth of the deposit, i.e. on the distance from the horizontally laid inductors 10 to the earth's surface 5. The pressure should be higher than the hydrostatic pressure of the corresponding water column and lies for example in the range between 5000 hPa (5 bar) and 50000 hPa (50 bar).

Pressure in the deposit 6 is relieved by opening the production well(s) (not shown in FIG. 1) at a time at which the pressure on an overburden present above the deposit 6 becomes too high. It can however be advantageous to keep the production wells closed for as long as possible in order to reach a high pressure in the reservoir 6.

In order to optimize the pressures use can be made of devices called "artificial lift pumps", which exert an influence on the so-called "bottom hole" pressure and by means of which the produced medium can be transported out of the reservoir through the production wells.

The function of the escaping fluid 22 is therefore not only to lower the viscosity and increase or maintain the pressure in the deposit 6, but also to displace—flush out—the substance that is to be extracted, while at the same time successfully avoiding a negative pressure in the deposit 6.

Examples of suitable solvent fluids include gases—for example ethane, propane, butane, $CO_2$, $SO_2$, etc.—as well as liquids—e.g. polymers or water mixtures containing polymers. Multicomponent mixtures are also conceivable. According to the method said solvents enter the reservoir, dissolve in the bitumen of the deposit and lower the viscosity of the bitumen. The solvents can also be combined or mixed—propane, for example, can be used as a solvent with another gas (e.g. methane)—in order to ensure the volumetric flow rate and pressure required for displacing the oil.

Figure 2:
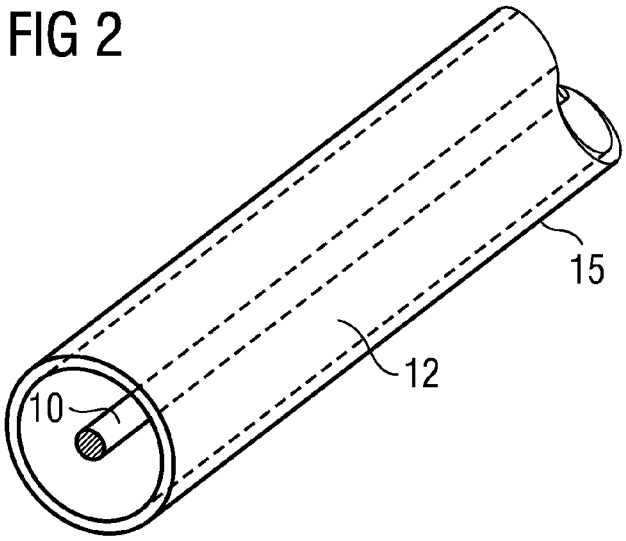
FIG. 2 shows a perspective view of an inductor having fluid conducting means.

A section of an inductor 10 having a surrounding fluid conducting means 12 is illustrated schematically in a perspective view in FIG. 2, the section shown having no exit holes in the fluid conducting means 12. An inductor 10 arranged centered in a tubularly embodied jacket 15 of the fluid conducting means 12 is surrounded by a fluid conducting means 12. The positioning of the inductor 10 can be determined for example solely by means of forces of the through-flowing fluid in the fluid conducting means 12. Centering, as indicated in FIG. 2, can be dispensed with in this case. The inductor 10 is accordingly largely freely movable in the fluid conducting means 12 and could also come to rest e.g. on the fluid jacket due to the weight force from inside. However, various embodiments for a specific positioning or fixing of the inductor in the fluid conducting means 12 are presented in the following.

The diameter of the inductor 10 can preferably amount to 30 to 100 mm. The annular clearance width of the inductor 10 will preferably range from 5 mm to 50 mm.

Cross-sections of conductors combined with a fluid conducting means are illustrated schematically hereinbelow. The cross-section is made along an intersecting plane which is formed at right angles to the extension of the fluid conducting means.

Figure 3:
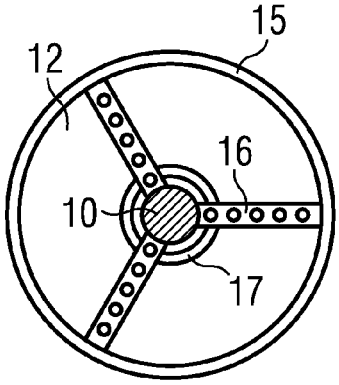
FIGS. 3, 4, 5 show cross-sections of different inductors having fluid conducting means.

According to FIG. 3, the inductor 10 is supported for example by means of star-shaped spacers—bars 16—, with preferably two to five spacers being used. However, a solution using only one bar 16 is also conceivable. The bars 16 are preferably mounted on the internal wall of the jacket 15 and are connected in the center via stabilizers 17 or attached directly to the outer sheath of the inductor 10. The inductor 10 is located coaxially in the center of the jacket 15 of the fluid conducting means 12 and is either installed as a unit with the jacket 15 and the bars 16 or inserted subsequently.

The fluid conducting means 12 is produced from the cavities inside the jacket 15.

The width of the bars 16 can lie, for example, in the 5-30 mm range to ensure that the pressure losses of the fluid in the fluid conducting means 12 do not become too great.

Figure 4:
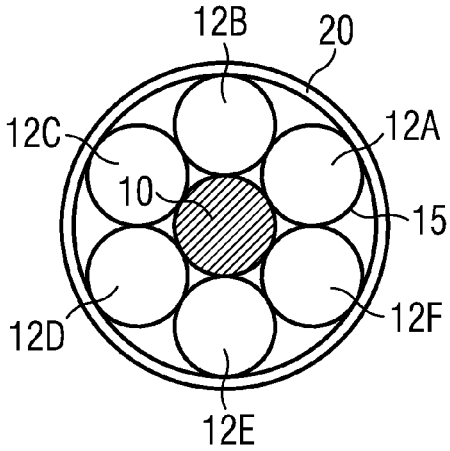

According to FIG. 4, a plurality of tubes or pipes 12A, 12B, . . . , 12F are provided as fluid conducting means 12 in the annular space—i.e. inside an outer sheath 20—around the inductor 10.

Figure 5:
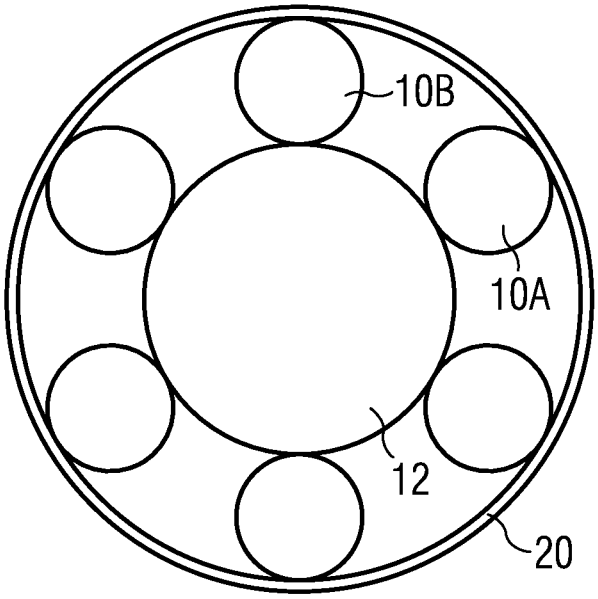

According to FIG. 5, a further variant is shown in which a central tube or pipe conducting the solvent fluid as fluid conducting means 12 is encircled by the subconductors 10A, 10B, . . . . In this case the subconductors 10A, 10B, . . . , seen together, constitute the inductor 10. Overall, the subconductors 10A, 10B, . . . and the fluid conducting means 12 are enclosed by an outer sheath 20.

Whereas the conducting of a fluid per se has been explained thus far hereintofore, attention in the following will turn to the other essential aspect, namely that the fluid is discharged into the deposit 6 by way of the fluid conducting means 12, for example via the end of an injector or over the length of the fluid conducting means 12. Even if it is not explicitly mentioned, the cross-sections presented in FIGS. 2 to 5 can be used for sections of the fluid conducting means 12 in which the fluid 22 is intended to escape.

Figure 6:
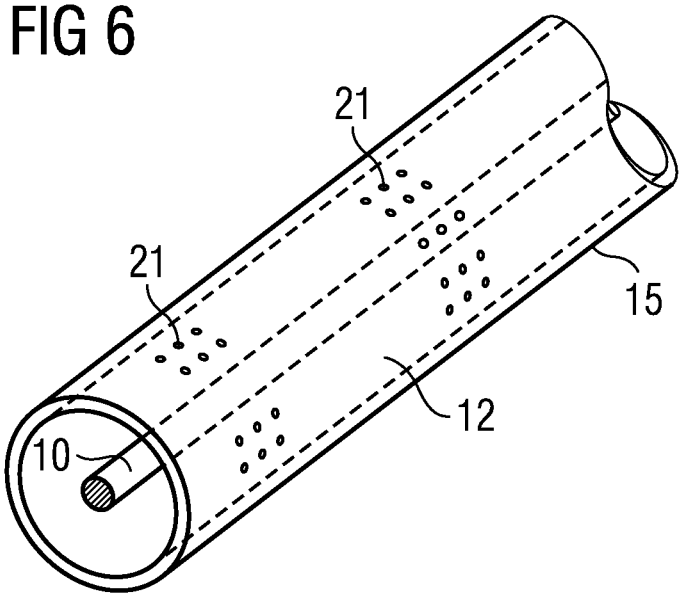
FIG. 6 shows a perforated fluid conducting means.

FIG. 6 shows in schematic form a section of an inductor 10 having a surrounding fluid conducting means in a perspective view, a fluid conducting means 12 being embodied as perforated so that the transported fluid can escape, the fluid being able to escape as gas or liquid or as a multiphase mixture.

Analogously to FIG. 2, an inductor 10 arranged centered in a tubularly embodied jacket 15 is surrounded by a fluid conducting means 12. In contrast to the embodiment shown in FIG. 2, the fluid conducting means 12 or the jacket 15 contains a perforation 21 consisting of a plurality of holes and passages through which the transported fluid can permeate from inside to outside. The size, position and frequency of the holes should in this case be adapted to the desired conditions and is not to be interpreted as limiting as a result of the illustration in FIG. 7.

The holes of the perforation 21 can in this case be arranged symmetrically over the entire circumference of the jacket 15. It could, however, also be advantageous to provide a nonuniform distribution. The distribution and/or embodiment of the holes can also be varied over the length of the fluid conducting means 12, in particular since the pressure inside the fluid conducting means 12 can change on account of the escaping fluid.

A fluid escaping into the deposit 6 in the environment of the inductor 10 has an advantage in this case to the extent that in this way a solvent can be injected into the reservoir, as a result of which on the one hand the viscosity in the deposit 6 can be reduced and on the other hand an increase in pressure can be produced within the deposit 6. The product of both effects is that the extraction quota and/or the extraction rate of the hydrocarbon-containing substance that is to be extracted can be increased.

In all embodiments of the invention—although not shown in some cases—a production well is present in the earth for transporting the substance that is to be extracted. A production flow in the form of a liquid-solid-gas mixture—i.e. a phase mixture—can be transported by way of the production well to the earth's surface for processing. Various embodiments are explained hereinbelow with reference to schematic figures which are each different from one another in terms of the arrangement of the inductors, the fluid injectors and the production well.

Figure 7:
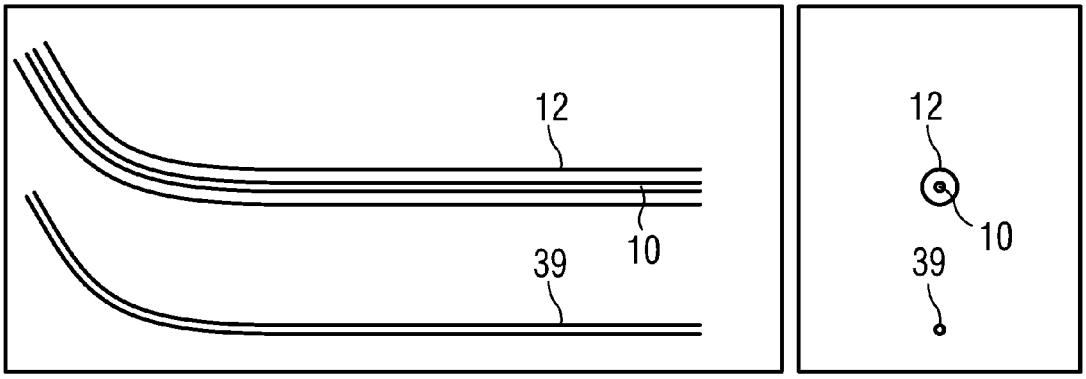
FIGS. 7-11 show different embodiments of the device according to the invention.

According to FIG. 7, analogously to FIG. 1, a combined injector-inductor is shown from two different perspectives in each case. The fluid conducting means 12 again surrounds the conductor 10 and runs horizontally inside the deposit. A production well 39 is also provided, essentially vertically below the combined injector-inductor.

Figure 8:
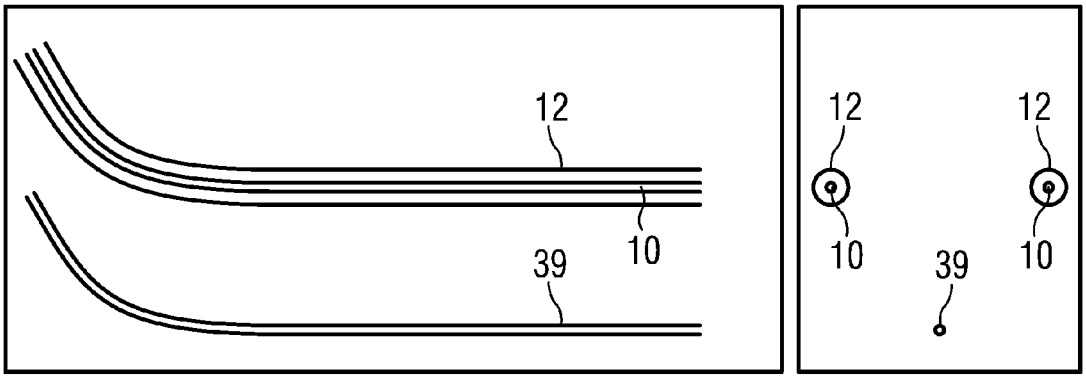

FIG. 8 shows a variation of FIG. 7 in which conductors 10 of a conductor loop running parallel to each other—outgoing and return conductors—are shown. The fluid conducting means 12 surrounds the outgoing/return conductor 10 in each case and runs horizontally inside the deposit. In this exemplary embodiment the production well 39 is preferably arranged centered between the conductors 10, though once again below the level of the installed conductors 10. In an intersecting plane perpendicular to the extension direction of the conductors and the pipelines, the combined injector-inductor pairs 10,12 and the production well 39 are therefore arranged essentially in a V shape. Analogously, the production well can likewise be positioned in a V shape between two conductor loops (e.g. between the outgoing conductor of a first conductor loop and the return conductor of another, second conductor loop).

Figure 9:
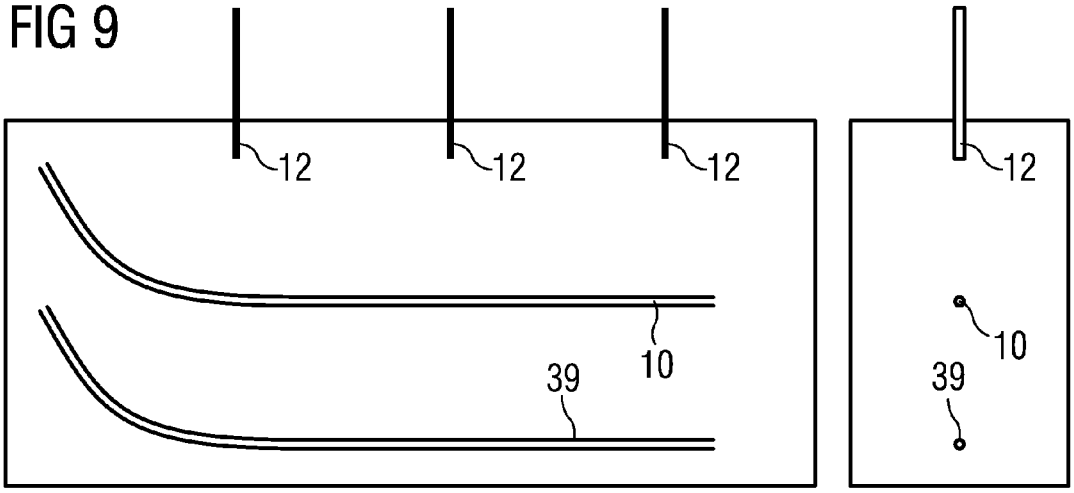
Figure 10:
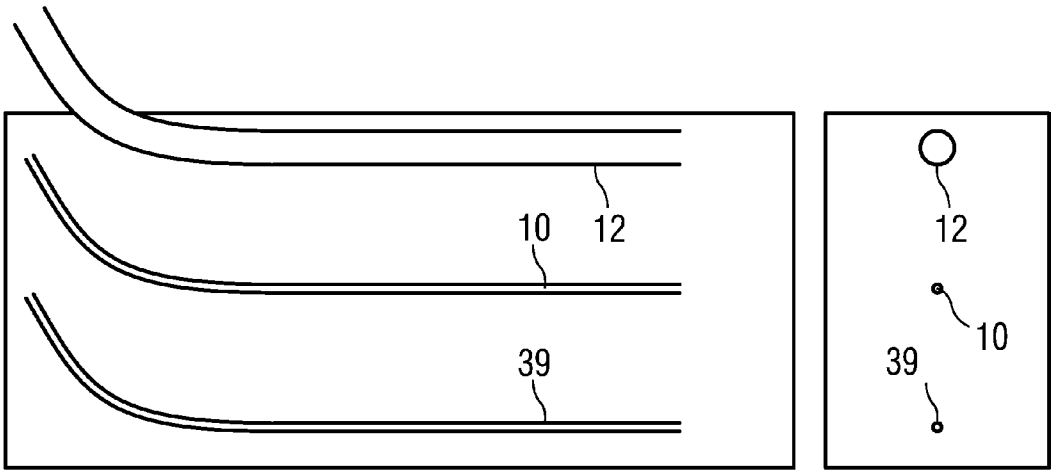
Figure 11:
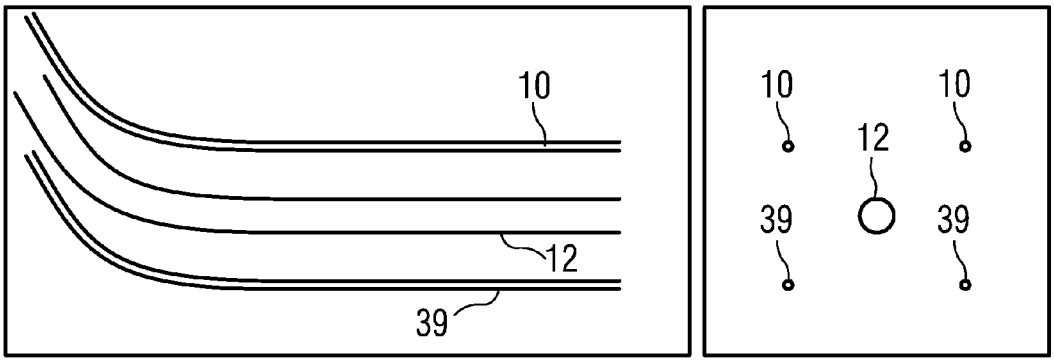

FIGS. 9 to 11 now show embodiments in which the conductors 10 are not formed as a unit with the fluid conducting means 12, but are installed separately.

According to FIG. 9, the conductor 10 and the production well 39 are again laid horizontally in the deposit. A production well 39 is additionally arranged essentially vertically below the conductor 10. The fluid conducting means 12 is routed for example perpendicularly into the deposit, wherein preferably a plurality of fluid conducting means 12 can be provided spaced at intervals from one another. The solvent is transported into the reservoir in the vertical direction by way of the plurality of fluid conducting means 12, the solvent preferably being able to exit only at a terminating piece of the respective fluid conducting means 12. In a preferred embodiment variant said terminating piece is positioned at a certain distance from the conductor 10 vertically above the conductor 10.

FIG. 10 shows an embodiment in which the conductor 10, the production well 39 and the fluid conducting means 12 are embodied as separate components, although in terms of their spatial orientation they are embodied essentially uniformly. All the components run essentially horizontally within the deposit. The fluid conducting means 12 is arranged vertically above the conductor 10, which in turn is arranged vertically above the production well 39.

FIG. 11 shows another embodiment in which the conductor 10, the production well 39 and the fluid conducting means 12 are embodied as separate components and are embodied essentially uniformly in terms of their spatial orientation, with all the components running essentially horizontally within the deposit. The conductor loop is embodied as a conductor pair, the conductors 10 of the conductor pair being arranged largely in a horizontal plane. Two production wells 39 are provided which preferably are likewise arranged in a horizontal plane, with a respective one of the production wells 39 being arranged essentially vertically below one of the conductors 10. In this embodiment the fluid conducting means 12 is located in a central area between the conductors 10 and the production wells 39, below the conductors 10, above the production wells 39, and essentially centrally between the conductor pairs and/or production well pairs.

Common to all the embodiments is that electromagnetic-inductive heating is employed for heating petroleum deposits, supported by the injection of solvents.

The solvent is preferably injected continuously, without interruption in time. If necessary, the injection of the solvent can also be used for pretreating the deposit, e.g. the injection is carried out before the actual operational extraction process in order to reduce the viscosity of the oil in the vicinity of the production well. In this way the amount of energy consumed for a possibly used preheating of the deposit is reduced or even avoided.

Using fluids—gaseous or liquid, single-phase or as a mixture—in addition to the inductive heating leads on the one hand to a further reduction in the viscosity of the oil and on the other hand enables the oil to be displaced from the deposit. The total amount of energy consumed for extracting the oil or bitumen is reduced as a result. Because the introduction of water vapor can be dispensed with, water consumption is reduced and less investment in plant resources for treating the produced water is required. Furthermore, a faster extraction rate or higher extraction quota can be achieved.

The invention claimed is:

1. A device for extracting a hydrocarbon-containing substance from a reservoir, wherein thermal energy can be applied to the reservoir in order to reduce the viscosity of the substance, the device comprising:

at least one conductor loop for inductively supplying electric current, to provide electric and/or electromagnetic heating, and a fluid conducting tube for transporting and introducing a solvent fluid into the reservoir, to further reduce the viscosity of the substance, and a pressurizing device, wherein the fluid conducting tube is perforated and is arranged in the reservoir such that when the solvent fluid is supplied the solvent fluid moves out of the fluid conducting tube into the reservoir only by way of a perforation, wherein the perforation has holes which are embodied in terms of shape and/or size and/or distribution in such a way that when the solvent fluid is supplied under a predetermined pressure applied by the pressurizing device, the solvent fluid is discharged in a distributed manner into the reservoir over a length of the fluid conducting tube through the perforation into an environment of the fluid conducting tube, wherein the applied predetermined pressure is dependent on a depth of the reservoir and is higher than a hydrostatic pressure corresponding to said depth of the reservoir, wherein the perforations are embodied in such a way that the same amount of fluid is discharged in each section over the entire length of the fluid conducting tube; and wherein the fluid conducting tube is internal to the conductor, wherein the perforation is embodied in such a way that an electrical insulation of holes of the perforation is provided with respect to the conductor.

2. The device as claimed in claim 1, wherein a conductor of the conductor loop comprises a plurality of subconductors which surround the fluid conducting tube in at least one section.

3. The device as claimed in claim 1, wherein the conductor and the fluid conducting tube are embodied separately from each other.

4. The device as claimed in claim 1, wherein the fluid conducting tube is arranged approximately coaxially with respect to the conductor.

5. The device as claimed in claim 1, wherein the perforation is embodied in such a way and/or an arrangement is provided so that an infiltration of solid bodies and/or sands from the reservoir into the fluid conducting tube is substantially prevented.

6. A method for extracting a hydrocarbon-containing substance from a reservoir, wherein thermal energy is applied to the reservoir in order to reduce the viscosity of the substance, the method comprising:

providing at least one conductor loop for inductively supplying current, the conductor loop being operable to provide electric and/or electromagnetic heating, transporting a solvent fluid through a fluid conducting tube into the reservoir, and introducing the solvent into the reservoir to further reduce the viscosity of the substance, wherein the fluid conducting tube is perforated and is arranged in the reservoir such that when the solvent fluid is supplied the solvent fluid moves out of the fluid conducting tube into the reservoir only by way of a perforation, wherein the perforation has holes which are embodied in terms of shape and/or size and/or distribution in such a way that when the solvent fluid is supplied under an applied predetermined pressure the solvent fluid is discharged in a distributed manner into the reservoir over a length of the fluid conducting tube through the perforation into an environment of the fluid conducting tube, wherein the applied predetermined pressure is dependent on a depth of the reservoir and is higher than a hydrostatic pressure corresponding to said depth of the reservoir, wherein the perforations are embodied in such a way that the same amount of fluid is discharged in each section over the entire length of the fluid conducting tube; and wherein the fluid conducting tube is internal to the conductor, wherein the perforation is embodied in such a way that an electrical insulation of holes of the perforation is provided with respect to the conductor.

7. The method as claimed in claim 6, further comprising conducting the solvent fluid under pressure into the fluid conducting tube such that a pressure greater than a pressure in the reservoir is present inside the fluid conducting tube in the region of the perforation in the environment of the perforation.

8. The method as claimed in claim 7, further comprising adjusting the pressure of the solvent fluid to a predetermined perforation in such a way that when the solvent fluid is supplied under said pressure the solvent fluid is discharged into the reservoir in a distributed manner over a length of the fluid conducting tube into an environment of the fluid conducting tube.

9. The method as claimed in claim 6, wherein a gas or a liquid or a multicomponent mixture is provided as the solvent fluid, comprising at least one constituents from the group consisting of:

alkanes;

water mixtures with wetting agents contained therein;

water mixtures with polymers contained therein;

acids;

bases;

$SO_2$; and $CO_2$.

10. The method as claimed in claim 6, further comprising:

closing a valve of a producer well for conveying away the liquefied hydrocarbon-containing substance from the reservoir, and opening the valve at a later time, dependent on a predetermined time interval having elapsed or on a predetermined pressure having been reached within the reservoir.

11. The method as claimed in claim 6, further comprising controlling an electrical property of the reservoir through introducing the solvent fluid into the reservoir.

12. A device for extracting a hydrocarbon-containing substance from a reservoir, wherein thermal energy can be applied to the reservoir in order to reduce the viscosity of the substance, the device comprising:

at least one conductor loop for inductively supplying electric current, to provide electric and/or electromagnetic heating, and a fluid conducting device for transporting and introducing a solvent fluid into the reservoir, to further reduce the viscosity of the substance, wherein the fluid conducting device is perforated such that when the solvent fluid is supplied the solvent fluid permeates out of the fluid conducting device into the reservoir by way of a perforation, and wherein the fluid conducting device is internal to the conductor, wherein the perforation is embodied in such a way that an electrical insulation of holes of the perforation is provided with respect to the conductor.

* * * * *